US006925818B1

(12) United States Patent
Brown

(10) Patent No.: US 6,925,818 B1
(45) Date of Patent: Aug. 9, 2005

(54) AIR CYCLE PRE-COOLING SYSTEM FOR AIR SEPARATION UNIT

(75) Inventor: Ross Brown, Murrieta, CA (US)

(73) Assignee: Cryogenic Group, Inc., Murrieta, CA (US)

( * ) Notice: Subject to any disclaimer, the term of this patent is extended or adjusted under 35 U.S.C. 154(b) by 0 days.

(21) Appl. No.: 10/613,503

(22) Filed: Jul. 7, 2003

(51) Int. Cl.[7] ..... F25B 9/00; F25J 3/00
(52) U.S. Cl. ..... 62/86; 62/645; 62/402
(58) Field of Search ..... 62/402, 401, 87, 62/640, 643, 644, 645, 646, 86

(56) References Cited

U.S. PATENT DOCUMENTS 2,856,758 A * 10/1958 Eggleston et al. ..... 62/88
3,477,239 A * 11/1969 Rische ..... 62/640
3,950,957 A * 4/1976 Zakon ..... 62/644
4,303,428 A * 12/1981 Vandenbussche ..... 62/646
4,382,366 A * 5/1983 Gaumer ..... 62/646
4,522,636 A * 6/1985 Markbreiter et al. ..... 62/87
4,711,645 A * 12/1987 Kumar ..... 95/98
4,732,597 A * 3/1988 Jujasz et al. ..... 62/652
5,157,926 A * 10/1992 Guilleminot ..... 62/646
5,406,786 A * 4/1995 Scharpf et al. ..... 60/775
5,918,472 A * 7/1999 Jonqueres ..... 62/87
6,526,775 B1 * 3/2003 Asfia et al. ..... 62/402

* cited by examiner

*Primary Examiner*—William C. Doerrler
(74) *Attorney, Agent, or Firm*—William W. Haefliger

(57) ABSTRACT

The method of processing air prior to separation of such air into gaseous components, the steps that include: first compressing a stream of air and cooling the compressed air, to enable water separation and removal from the stream, to provide a dry stream of air; then further compressing the dry air stream and cooling the compressed dry air stream to enable removal of contained remanent water; then expanding the cooled air stream in an expansion stage which extracts work from the expanding stream; then passing the expanded air stream to a separator operating to remove water from the stream, thereby producing dry air passed to a component gas separation stage or stages.

4 Claims, 2 Drawing Sheets

Figure 1:
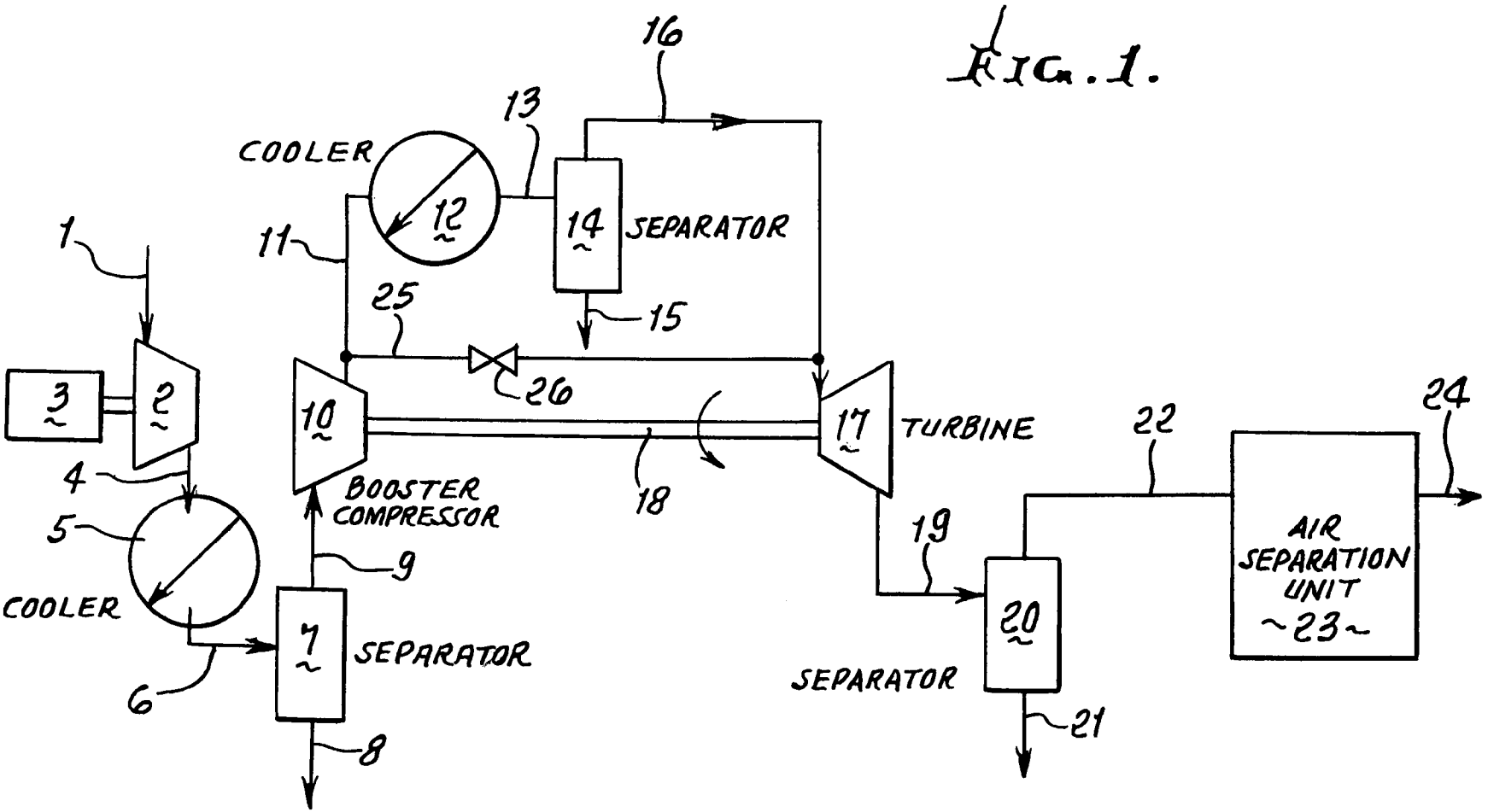

AIR SEPARATION UNIT
23
24
22
21
20
19
TURBINE
17
SEPARATOR
18
16
SEPARATOR
15
14
13
26
12
COOLER
25
11
BOOSTER COMPRESSOR
10
9
SEPARATOR
7
8
1
2
3
4
5
COOLER
6

AIR CYCLE PRE-COOLING SYSTEM FOR AIR SEPARATION UNIT

BACKGROUND OF THE INVENTION

This invention relates generally to processing of a stream of air prior to its separation into components, and more particularly concerns efficient drying and cooling of such air stream.

Air separation units (ASU) separate air into its constituent parts, nitrogen, oxygen and Argon. This is performed by distillation at low temperatures (−300 DegF.). Preliminary to cooling the air feed stock to the liquefaction point, it is necessary to remove the minor amounts of water and carbon dioxide present in air, prior to the introduction of air to the heat exchangers where the air is exposed to freezing temperatures. In modern plants this is done by a two step process. First the compressed air is cooled to about 5 DegC. (41 DegF.), where most of the water is removed by condensation and separation. Next the cooled air is passed through absorbent beds containing a suitable absorbent such as a molecular sieve, where the last traces of moisture and the carbon dioxide are removed. The reduced air temperature is necessary to provide the absorbent function with a high degree of affinity for carbon dioxide. The beds are regenerated periodically by either de-pressurization (Pressure Swing Absorption) or more commonly heating (Temperature Swing Absorption).

There is need for improvements in such processes, which typically employ mechanical refrigerators running with either Freon or ammonia. The evaporator operates at temperature close to freezing to prevent the water in the compressed air from freezing on the tube surfaces. The heat absorbed in cooling the air and condensing the water combined with the power used in the compressor is rejected to either air (ambient) or a cooling water circuit.

SUMMARY OF THE INVENTION

Basically, the invention provides a method of processing air prior to separation of such air into gaseous components and includes the steps:

a) first compressing a stream of air and cooling the compressed air, to enable water separation and removal from the stream, to provide a dry stream of air, b) then further compressing the dry air stream and cooling the compressed dry air stream to enable removal of contained remanent water, c) then expanding the cooled air stream in an expansion stage which extracts work from the expanding stream, d) then passing the expanded air stream to a separator operating to remove water from the stream, thereby producing dry air passed to an air component separation stage or stages.

The air cycle refrigeration process described herein, employs reverse Brayton cycle technology to replace the mechanical refrigerator and evaporator. While thermodynamically less efficient than the Rankine cycle equipment it replaces, it has the advantage of simplicity and the avoidance of employing chlorine/fluorine compounds which are potential damaging to the atmosphere.

These and other objects and advantages of the invention, as well as the details of an illustrative embodiment, will be more fully understood from the following specification and drawings, in which:

DRAWING DESCRIPTION

Figure 2:
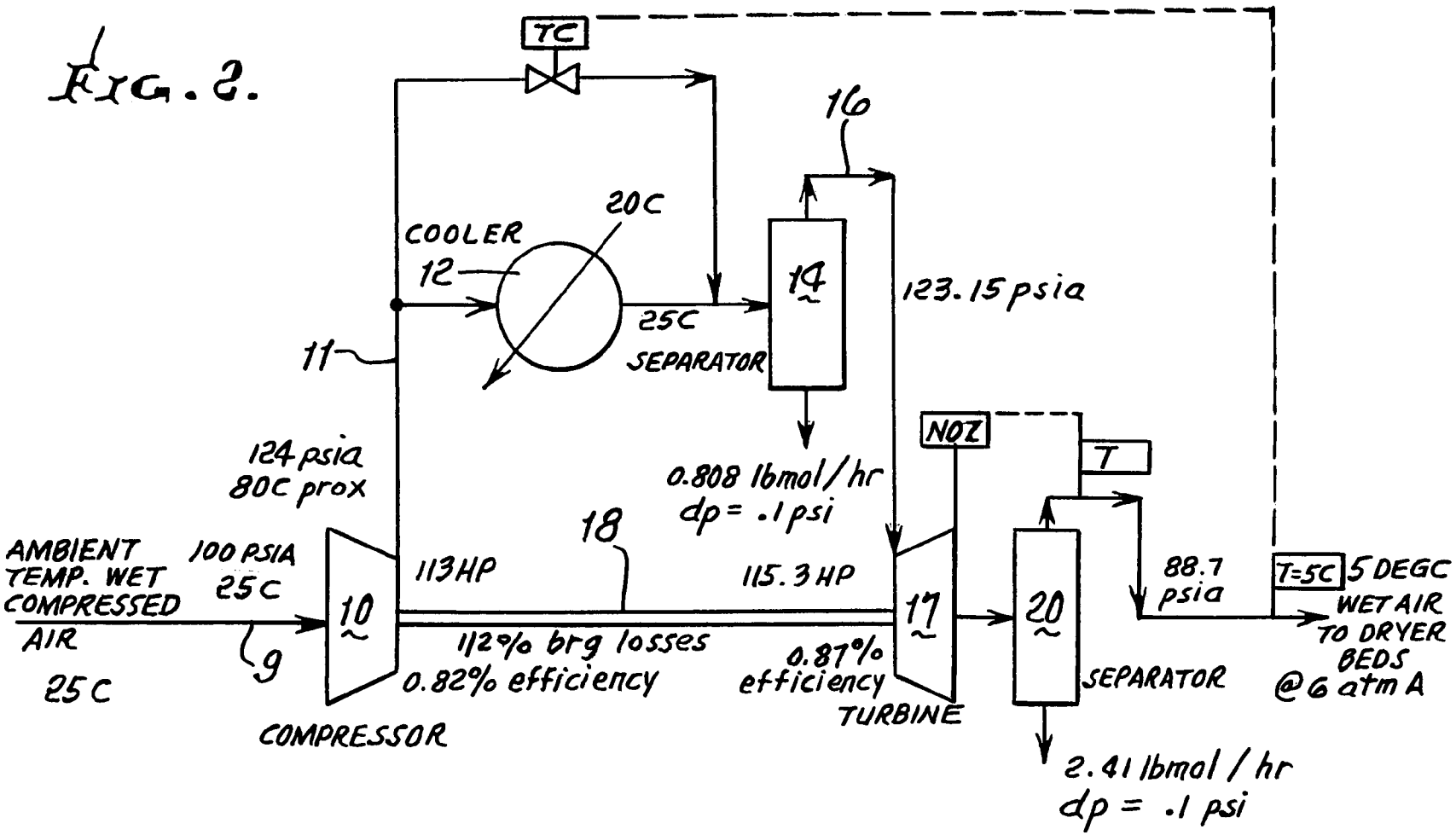

FIG. 1 is a flow diagram showing an air processing system employing the invention; and FIG. 2 shows a similar system.

DETAILED DESCRIPTION

In FIG. 1, supply air 1 is first compressed in a compressor 2, driven by a prime mover 3, to a higher pressure $p_1$ at 4 (normally to between 5 and 15 atm). The compressed air is then cooled in an after cooler 5, to a temperature $t_1$ using either ambient air or cooling water as the cooling medium to which heat is transferred. Cooled air is passed at 6 to separator 7. Water in excess of the dew point (condensed water) in the cooled compressed air is separated in separator 7 and removed at 8. The dry compressed air at 9 then enters a booster compressor 10 (normally a centrifugal compressor) where the pressure is increased to $p_2$. Exit air at 11 is cooled to temperature $t_2$ at cooler 12, and resulting wet air flows at 13 to a separator 14 where additional liquid water is separated and drained 15. The cooled boosted air provided at 16 is then expanded in an expansion device 17 (normally a turbine) where the extracted work cools the stream to temperature $t_3$ as the pressure is reduced to $p_3$. The work extracted as shaft power is used to power the booster compressor through a shaft 18.

The cooled wet air flows at 19 to a final separator 20 that removes the liquid water 21 produced in this final cooling. The cold dry air 22 flows to the air separation unit 23 and is separated into its constituent parts, oxygen, nitrogen and Argon. The product streams 24 are transported for use.

The final pressure $p_3$ is less than the discharge pressure $p_2$ of the air compressor. The difference in the air pressures and the resultant work that is required to get it there, represents the power penalty for producing the refrigeration.

Since it is necessary to maintain the turbine exhaust temperature at approximately 5 DegC. to prevent solid ice from forming in the exhaust, the inlet temperature to the turbine is controlled by bypassing the booster aftercooler 12. An air flow bypass line 25 and control valve 26 are provided for this purpose. The total flow through the system is controlled by adjusting the positions of the inlet nozzles on the turbine. See adjustment device 26.

In the similar FIG. 2 system, elements the same as in FIG. 1 bear the same identifying numbers. Representative physical conditions are shown.

What is claimed is:

1. In the method of processing air prior to separation of such air into gaseous components, the steps that include:

a) first compressing a stream of air and cooling the compressed air, to enable water separation and removal from the stream, to provide a dry stream of air, b) then further compressing the dry air stream and cooling the compressed dry air stream to enable removal of contained remanent water, c) then expanding the cooled air stream in an expansion stage which extracts work from the expanding stream, d) then passing the expanded air stream to a separator operating to remove water from the stream, thereby producing dry air passed to a component gas separation stage or stages, e) said b) step including operating a booster compressor to compress dried air at a booster compression stage, f) controllably passing compressed air to flow from the discharge side of the booster compressor to the inlet of a turbine which provides said expansion stage, thereby by-passing said cooling step and water removal step of sub-paragraph b), g) providing a flow control valve in the path of said by-passing air flow, h) and operating said valve to maintain the temperature of the exhaust air from the turbine at or above about 5° C.

2. The method of claim 1 wherein said booster compressor is driven by the turbine and operating to compress dried air at a booster compression stage defined at sub-paragraph b) in claim 1.

3. The method of claim 1 including the step of separating dried air into its component gases at said air component separation stage.

4. The method of claim 1 wherein the turbine has air inlet nozzles, and including the step of adjusting said nozzles to control air flow delivery to said component gas separation stage.

* * * * *